United States Patent [19]

Simoncelli et al.

[11] Patent Number: 4,836,588

[45] Date of Patent: Jun. 6, 1989

[54] AUTOMATIC DOUBLE-ACTION CASEMENT BOLT

[75] Inventors: Philippe Simoncelli, Sarrebourg; Gérard Prevot, Willerwald, both of France

[73] Assignee: Ferco International Usine de Ferrures de Batiment, Sarrebourg, France

[21] Appl. No.: 26,388

[22] Filed: Mar. 16, 1987

[30] Foreign Application Priority Data

Apr. 10, 1986 [FR] France ..... 86 05252

[51] Int. Cl.[4] ..... E05C 9/14

[52] U.S. Cl. ..... 292/34; 292/336.3; 292/DIG. 62

[58] Field of Search ..... 292/336.3, 34, 165, 292/170, 98, 124, 197, 224, 234, 21, 103, DIG. 62, 52, 45, 46; 70/DIG. 42

[56] References Cited

U.S. PATENT DOCUMENTS

| | | | |
|---|---|---|---|
| 122,061 | 12/1871 | Robie | 292/170 |
| 406,903 | 7/1889 | Hebert | 292/34 |
| 512,022 | 1/1894 | Gower, Jr. | 292/34 X |
| 543,679 | 7/1895 | Dennis | 292/174 X |
| 620,468 | 2/1899 | Lowery et al. | 292/170 X |
| 844,448 | 2/1907 | Gaylor | 292/147 X |
| 893,072 | 7/1908 | Hayes | 292/174 |
| 908,361 | 12/1908 | Vredenburgh et al. | 292/170 X |
| 1,174,652 | 3/1916 | Banks | 292/34 X |
| 1,354,646 | 10/1920 | Heintzelman | 292/147 |
| 1,493,872 | 5/1924 | Briney | 292/103 |
| 1,908,980 | 5/1933 | Heyel | 292/34 X |
| 2,423,352 | 7/1947 | Thiele | 292/103 X |
| 2,502,607 | 4/1950 | Vinton | 292/52 X |
| 2,888,288 | 5/1959 | Rigaud | 292/52 X |
| 3,498,657 | 3/1970 | Fontana | 292/34 |
| 3,904,229 | 9/1975 | Waldo | 292/103 X |
| 3,953,061 | 4/1976 | Hansen et al. | 292/34 X |
| 4,306,432 | 12/1981 | Ravid | 292/34 X |
| 4,616,864 | 10/1986 | Douglas | 292/336.3 |
| 4,634,160 | 1/1987 | Lahmann et al. | 292/336.3 |
| 4,648,638 | 3/1987 | McKnight | 292/165 X |

FOREIGN PATENT DOCUMENTS

| | | | |
|---|---|---|---|
| 594187 | 3/1934 | Fed. Rep. of Germany | 292/34 |
| 2154320 | 5/1972 | Fed. Rep. of Germany . | |
| 2633188 | 1/1978 | Fed. Rep. of Germany | 292/336.3 |
| 2730407 | 1/1979 | Fed. Rep. of Germany . | |
| 709399 | 6/1966 | Italy | 292/34 |
| 279219 | 3/1952 | Switzerland | 292/34 |

*Primary Examiner*—Lloyd A. Gall
*Assistant Examiner*—Curtis B. Brueske
*Attorney, Agent, or Firm*—Sandler & Greenblum

[57] ABSTRACT

This automatic double-action casement bolt comprises a pair of locking bars urged by resilient return means to a locking or bolting position in which the bars engage corresponding keepers, these bars being retracted from the keepers and moved to their unbolting position by a set of angular levers fulcrumed at their vertices on the casement bolt casing, each angular lever being connected through one arm to one of the sliding bars, each angular lever comprising, at the end of its other arm, a notch engageable by a catch of at least one control rod movable in a direction across the bars and formed integrally with an operating and control handle urged by other resilient means to its inoperative position, the notch of the other arm of each angular lever being formed in the edge of this arm so as to provide an open clearance of which the bottom constitutes a striking edge adapted, when the casement bolt is unbolted, to co-operate with the catch of the control rod.

17 Claims, 3 Drawing Sheets

VI
V
VII
VII

AUTOMATIC DOUBLE-ACTION CASEMENT BOLT

FIELD OF THE INVENTION

The present invention relates to an automatic double-acting casement bolt comprising a pair of bars urged by resilient return means to a locking or bolting position in a set of keepers and retracted to the unbolting position by a set of angular levers fulcrumed at their vertices in the bolt casing, each angular lever being connected via the end of one of its arms to one of said each angular lever comprising, at the end of its other arm, a notch engageable by a catch-forming portion of at least one control rod movable in a direction across said bars and formed integrally with an operating and control handle constantly urged by resilient means to its inoperative position.

THE PRIOR ART

An automatic double-acting casement bolt is already known which comprises a pair of bars urged by resilient means to a locking position in which they engage a set of keepers, and retracted therefrom by a set of angular levers fulcrumed at their vertices in a casement bolt casing, each angular lever being connected via the end of one of its arms to one of said bars and comprising, at the end of its other arm, a notch engageable by a catch carried by at least one control rod movable in a direction across said bars and forming an integral part of an operating and control handle constantly urged by resilient means to its inoperative position.

However, this known casement bolt involves the use of a handle in the form of an elongated bar having a certain flexibility so that it can exert a tractive effort on the control rod and thus actuate the angular levers and retract the bars from the keepers.

Now this handle structure is objectionable not only on account of its excessive overall dimensions and its considerable cost, but also because the bolt mechanism transmitting to the bars the impulse exerted by the operator on the handle acts as a permanent coupling between this handle and the bars. Thus, when closing the window or door leaf, the bars cannot easily penetrate into the corresponding keepers. In fact, to close the leaf, the handle must be pushed in. This pressure is transmitted to the bars via the casement bolt mechanism and counteracts any backward movement of the bars. However, this backward movement is necessary to enable the bars to penetrate into the keepers. Therefore, during the last portion of the leaf closing movement the handle must be released so as to exert a pressure directly on the leaf and thus cause the bars to recede and permit their locking engagement with the keepers, and set the casement bolt in its locked condition.

It is the essential object of the present invention to provide an automatic casement bolt that can be fitted indifferently to hinge leaves opening outwardly or inwardly while permitting an easy and safe closing of the leaves.

SUMMARY OF THE INVENTION

For this purpose, the present invention is directed to provide a double-acting casement bolt of the automatic type, which comprises a pair of bars either urged by resilient means in a locking position in which they engage a set of corresponding keepers, or retracted to an unbolted position by a set of angular levers fulcrumed at their vertices on the casement bolt casing, each angular lever being connected through the end of one of its arms to the corresponding bar, each angular lever comprising, at the end of its other arm, a notch engageable by a catch formed at the end of at least one control rod movable in a direction across said bars and formed integrally with an operating and control handle urged in turn by resilient means to its inoperative position, this casement bolt being characterised in that the notch of the other arm of each angular lever is formed on the edge of said arm so as to constitute an open clearance of which the bottom constitutes a striking edge adapted, when the casement bolt is unbolted, to co-operate with the catch of the control rod.

By virtue of these various specific features of the present invention, it is now possible not only to actuate the operating and control handle for retracting the bars from their keepers when opening the casement leaf, but also to exert a pressure on said handle for closing the leaf, without interfering with the locking movement of the bars in said keepers. In fact, during the leaf opening movement the catch of the control rod co-operates with the striking edge of the angular levers to retract the bars and thus permit the opening of the casement leaf, and during the leaf closing movement the co-operation between these component elements cannot interfere with the locking engagement between said bars and said keepers.

As a consequence of the disengagement of the catch of said control rod from the notch of said angular lever, it is possible to add an extra idle or no-load stroke to the catch stroke which is defined by said striking edge and one of the lateral walls of the casing.

As explained hereinabove, this invention, by introducing this extra idle stroke, creates working conditions leading to a conception capable of warranting a positive a nd reliable closing of the leaf such as to palliate a possible failure of the resilient return means associated with the bars, or in case, for any reason, the force necessary. for introducing the bars into the corresponding keepers were greater than the force of said resilient return means.

The automatic casement bolt according to the instant invention is easier to operate and can be used indifferently for a right-hand or a left-hand leaf, by simply inverting the device, when the control handle is a lever coupled to the casing and fulcrumed about an axis parallel to the bars and comprising, opposite the lever arm, the control rod provided with the aforesaid catch.

This easier operation of the automatic casement bolt is further improved by a specific feature consisting in providing said operating and control handle with a pair of parallel spaced control rods each adapted to engage through its catch the striking edge of an angular lever protruding in its field of action.

This last feature is advantageously completed by the fact that the striking edge of each angular lever comprises a concave curved section facilitating the sliding movement of the catch on the striking edge, and that each bar comprises at its end coupled to the corresponding angular lever a slide guided in the casing and operatively connected to the angular lever through a slot-engaging coupling member.

With this particular arrangement of the present invention it is possible to conceive an automatic casement bolt having independent bars, this feature facilitating the storage of the casement bolts and their manufacture in standardized dimensions. According to the present invention, each slide can be coupled to a bar by means of a suitable and known member or device.

In order to positively close the leaf, this invention provides at each bar end connected to the corresponding angular lever a ramp extending across the path followed by the corresponding catch during the extra idle stroke of the handle.

As a consequence of the combined action of the ramp and of its corresponding catch, the bars are constantly pushed home to their locking or bolting position, even when a warped leaf or any other interference prevents the automatic resilient return movement of the bars. The catches carried by the control rod slide along these ramps during the idle stroke of the operating and control handle and push said bars to their locking position.

Other advantages and features of the invention will appear as the following description proceeds with reference to a preferred form of embodiment thereof, in the case of a leaf opening outwardly, reference being made to the attached drawings.

THE DRAWINGS

FIG. 1 is a section taken along the line 1—1 of FIG. 5, and shows the position of the essential component elements of the casement bolt mechanism when the operating and control handle is in its inoperative position, FIG. 2 is a view similar to FIG. 1 but showing the mechanism condition when the operating and control handle is in the position just preceeding the opening of the leaf, FIG. 3 is another view similar to FIG. 1 but showing the bolt mechanism in the unbolting position, FIG. 4 is a view similar to FIG. 1 but wherein the return movement of the handle to its inoperative position is prevented by an insufficient backward movement of the bars, FIG. 5 is a cross-section taken along the line V—V of FIG. 1, FIG. 6 is a cross-section taken along the line VI—VI of FIG. 5, and FIG. 7 is a view also in section taken along the line VII—VII of FIG. 2.

FIG. 8 is a perspective view of the operating and control handle, control slides, and ramps of the casement bolt mechanism.

DESCRIPTION OF THE PREFERRED EMBODIMENT

Figures 1, 2, 3, 4:
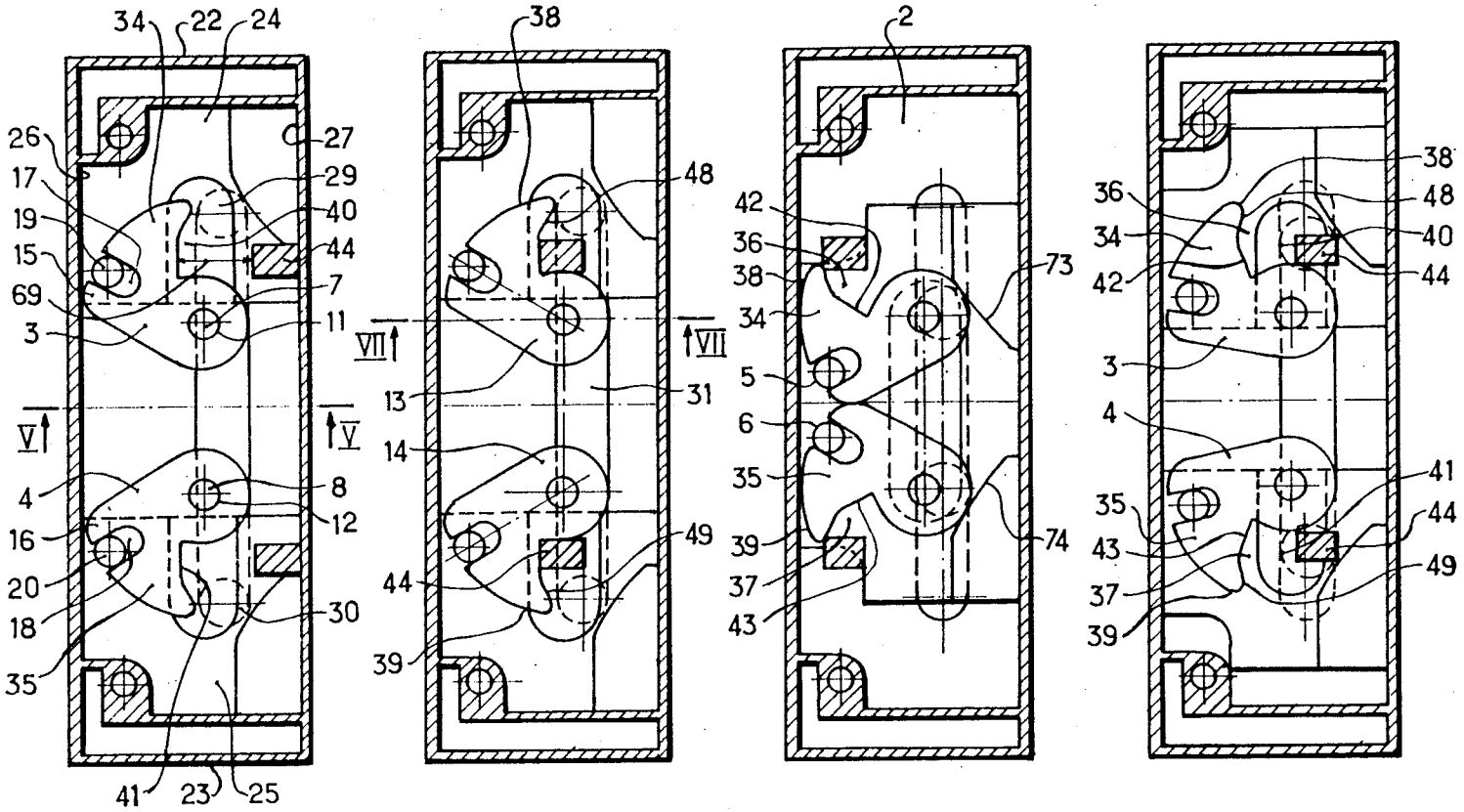

The double-acting automatic casement bolt 1 according to the present invention comprises a casing 2 enclosing a mechanism for actuating a pair of bars movable in opposite directions and adapted to engage keepers (not shown) provided on the window- or door-frame so as to lock the leaf in its closed position. Both bars (not shown) of the pair are urged to their locking position in said keepers by resilient return means (not shown).

The bolt mechanism comprises a set of angular levers 3, 4 connected through studs 5, 6 to the bars: these levers 3, 4 are pivotally mounted on pivot pins 7, 8 secured to the inner surface 9 of one of the major side faces 10 of the bolt casing 2, respectively. Said pivot pins 7, 8 extend through orifices 11, 12 formed in the vertices 13, 14, respectively, of said angular levers 3, 4. Each angular lever 3, 4 comprises a first... arm 15, 16 in which a notch 17, 18 is formed for engagement by a stud 19, 20, respectively.

In a first form of embodiment, the studs 19, 20 are rigidly connected to one face 21 of the end portion of a corresponding bar extending through apertures formed in the end faces 22, 23 of casing 2.

In a modified form of embodiment, the studs 19, 20 are each rigidly connected to one face 21 of a slide 24, 25 movable in the longitudinal direction in the casing 2 and guided by the lateral walls 26, 27 of this casing. In this case, the opposite face 28 of each slide 24, 25 is provided with a coupling member 29, 30 extending through an elongated aperture 31 formed in the other wall 32 of casing 2. This coupling member 29, 30 projects from the outer surface 33 of the other major side face 32 of casing 2. Advantageously, this coupling member 29, 30 has the shape of an axle on which the end of one bar is fitted. Thus, the casing 2 can be detached from the bars to facilitate the storage of a plurality of automatic casement bolts of the same size. On the other hand, the length of said bars can be adjusted as a function of the vertical dimension of the leaf.

Each angular lever 3, 4 comprises a second arm 34, 35 also provided with an aperture 36, 37, respectively. However, this aperture 36, 37 is formed on the edge 38, 39 of the second arm 34, 35 so that an open recess 40, 41 is obtained. The bottom of this open recess 40, 41 constitutes a striking edge 42, 43 for the means actuating said angular levers 3, 4.

One of said actuating means consists of a catch 44 formed at the end of at least one control rod 46 movable in a direction across the bars. This end 45 carrying the catch 44 is movable in an aperture 47 formed in the wall 10 of casing 2. During the bolt opening movement, this catch exerts a thrust against the striking edge 42, 43 of the open recess 40, 41 of the other arm 34, 35 of angular levers 3, 4, respectively. To facilitate the sliding movement of said catch 44 on striking edge 42, 43, this striking edge 42, 43 comprises a concave curved section 48, 49.

The control rod 46 is rigidly connected to, or formed integrally with, an operating and control handle 51 fulcrumed on a pivot pin 52 held in position by a strap 53 rigidly coupled to the outer surface 54 of the major side wall 10 of casing 2. When the operating and control handle 51 is actuated, it pivots about pin 52 and this movement is also attended by the rotation of control rod 46 about the same pin 52. The operating and control handle 51 is constantly urged to its inoperative position by resilient means 55, for instance a spring coiled around the pin 52 and having a fixed arm 56 and another arm 57 exerting a constant resilient pressure against the edge 58 of control rod 46.

Figure 6:
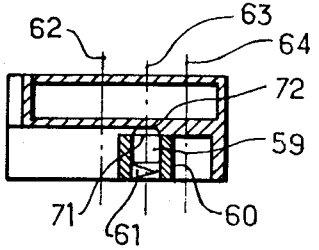
Figure 7:
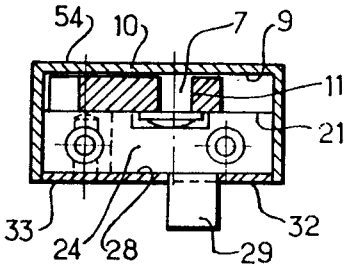

This control rod 46 comprises a positioning pawl 59 slidably engaging a hub 60 and urged to its operative position by resilient means 61. As shown in FIG. 6, the positioning pawl 59 is adapted to be set in three positions 62, 63, 64. The first position 62 corresponds to the position 65 of the operating and control handle 51 when the latter is pushed home for opening the door or window leaf: the second position 64 of pawl 59 corresponds to the inoperative position 66 of the operating and control handle 51, and the intermediate position 63 of the positioning pawl 59 keeps the operating a nd control handle 51 in an intermediate position 67 in which the leaf is closed and locked.

Advantageously, the operating and control handle 51 comprises a pair or parallel spaced control rods 46 each adapted to actuate via its catch 44 the striking edge 42, 43 of an angular lever 3, 4 protruding in its field of action.

Figure 5:
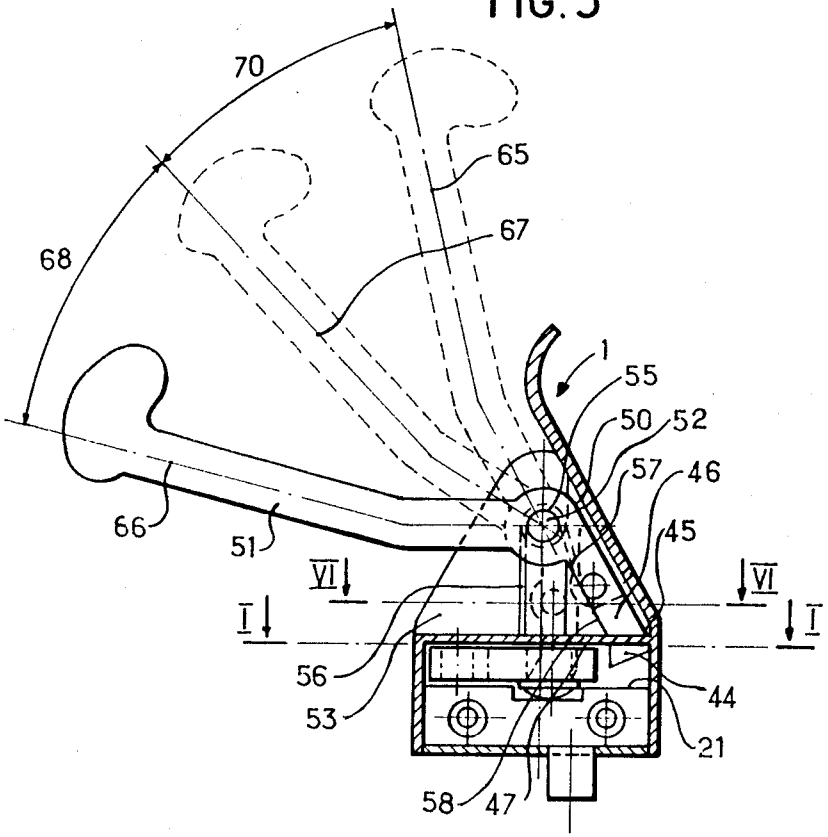
Figure 8:
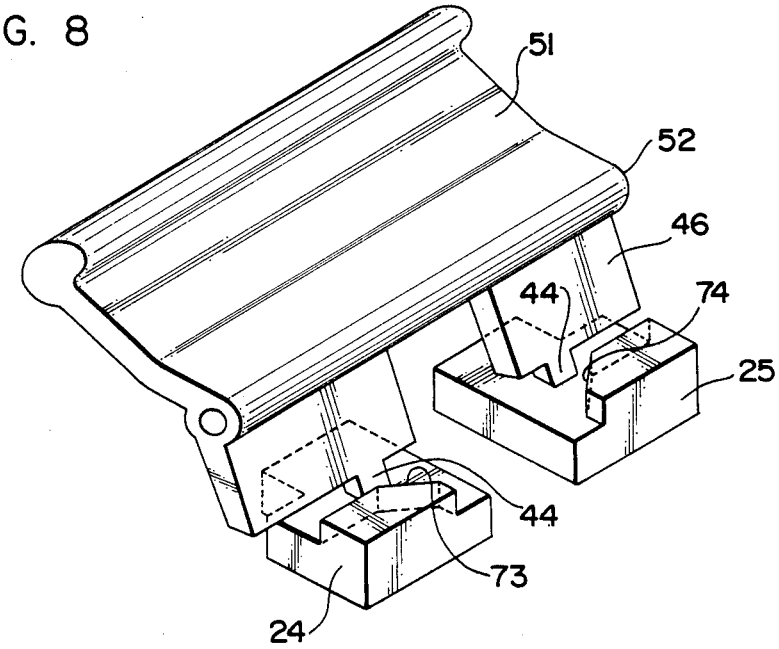

The automatic double-action casement bolt according to the present invention operates as follows :

Assuming that the automatic bolt 1 is in its locking or bolting position, the catch 44 of control rod 46 bears against the inner face of lateral wall 27 of casing 2, the operating and control handle 51 is in position 66 and the positioning pawl 59 is in position 64 (see FIGS. 1 and 5). The operating and control handle 51 is moved to its intermediate position 67 through an angle 68. This operating and control handle 51 performs an idle stroke 68 corresponding to an idle stroke 69 of catches 44 which are thus caused to engage the striking edges 42, 43 of angular levers 3, 4 (see FIGS. 2 and 5).

By continuing the movement of the operating and control handle 51, the catches 44 actuated thereby exert a pressure against the striking edges 42, 43, thus causing the rotation of angular levers 3, 4 and compressing the resilient member 55. As a consequence of this rotational movement of angular levers 3, 4 the first arms 15, 16 thereof, due to the coupling of notches 17, 18 with studs 19, 20, respectively, cause the slides 24, 25 to move toward each other so that the bars are retracted to unbolt the door or window leaf.

At the end of the additional stroke 70, the operating and control handle 51 is in position 65 and the positioning pawl 59 is in position 62 (see FIGS. 3 and 5).

When the operating and control handle 51 is released, it is returned to its intermediate position 67 by the pressure of resilient member 55 and the positioning pawl 59 is moved to its intermediate position 63. The other resilient member 61 causes the head 71 of said pawl 59 to engage a stop hole 72 formed in casing 2, thus retaining the operating and control handle 51 in its intermediate position 67 and closing the leaf. During this movement, the catch 44 is moved in the opposite direction under no-load conditions (idle stroke 69), as shown in Figures 4 and 5. However, it may happen that the automatic return movement of the bars cannot take place on account of a failure in the resilient return means associated with the bars, due for example to a warped leaf or to any other reason.

To palliate this inconvenience, each end of the bar coupled to its angular lever 3, 4, that is, each slide 24, 25, is provided with a ramp 73, 74 projecting from the face 21 of slides 24, 25. This ramp 73, 74 extends across the path of the corresponding catch 44 during the no-load or idle stroke of the operating and control handle 51. By moving this operating and control handle 51 back from position 67 to position 66, the catch 44 will slide along the ramp 73, 74 and push the slides 24, 25 backwards. This movement is transmitted through the coupling members 29, 30 to the bars. Thus, the corresponding bars are moved back to their locking or bolting position and therefore engage their corresponding keepers.

We claim:

1. A double-action casement bolt comprising:

(a) a casing comprising a surface;

(b) opposed levers pivotally mounted on said casing surface;

(i) for pivoting apart to a first position, to project locking elements to a locking position; and (ii) for pivoting together to a second position, to retract locking elements to an unlocking position; said opposed levers returning to said first position when not pivoted to said second position, and each of said opposed levers comprising a peripheral surface for engagement to pivot said levers to said second position;

(c) an actuable means, mounted on said casing, for engaging said peripheral surfaces to pivot said levers to said second position when actuated, and for withdrawing from engagement with said peripheral surfaces when not actuated, said actuatable means comprising at least one control rod for pivoting, in an arc substantially perpendicular to said casing surface;

(i) toward said opposed levers to contact said peripheral surfaces; and (ii) away from said peripheral surfaces to withdraw from contact with said peripheral surfaces; said at least one control rod comprising two catches, one for contacting each of said peripheral surfaces; and (d) resilient means mounted on said actuable means for urging said actable means to withdraw from engagement with said peripheral surfaces when said actuable means is not actuated.

2. The double action casement bolt as defined by claim 1 wherein said at least one control rod comprises two parallel control rods spaced apart from one another, each comprising one of said two catches.

3. The double action casement bolt as defined by claim 1 wherein said actuatable means further comprises an operating and control handle integral with said at least one control rod.

4. The double action casement bolt as defined by claim 3 wherein each of said opposed levers comprises:

(a) a first arm for connection to a locking element; and (b) a second arm comprising said peripheral surface.

5. The double action casement bolt as defined by claim 4 wherein said casing comprises a wall for contacting said catches to halt said at least one control rod in pivoting away from said peripheral surfaces, said wall being spaced apart from said peripheral surfaces.

6. The double action casement bolt as defined by claim 4 wherein said actuatable means comprises a first class lever, said operating and control handle comprising one arm of said first class lever for pivoting in an arc substantially perpendicular to said casing surface, and said at least one control rod comprising the other arm of said first class lever.

7. The double action casement bolt as defined by claim 4 wherein each of said second arms comprises a curve for facilitating sliding movement of a catch on said peripheral surface.

8. The double action casement bolt as defined by claim 4 further comprising two locking elements, each associated with one of said opposed leers, said locking elements being mounted in said casing for lateral sliding movement to separate and project into a locking position upon the pivoting apart of said opposed levers, and to come together and retract into an unlocking position upon the pivoting together of said opposed levers.

9. The double action casement bolt as defined by claim 8 wherein each of said locking elements comprises a ramp, said ramps forming an opening which narrows in the direction that said control rod pivots away from said peripheral surfaces, such that said catches, upon contacting said ramps during the pivoting of said at least one control rod away from said peripheral surfaces, extend said locking elements into said locking position.

10. The double action casement bolt as defined by claim 4 wherein the first and second arms of each of said opposed levers form a notch therebetween, said double action casement bolt further comprising two slides, each associated with one of said opposed levers and mounted in said casing for lateral sliding movement to separate in said casing upon the pivoting apart of said opposed levers, and to come together upon the pivoting together of said opposed levers, each slide comprising:

(a) a stud engaging the notch of the opposed lever with which said slide is associated; and (b) means for connecting said slide to a locking element.

11. The double action casement bolt as defined by claim 10 wherein said meant for connecting said slide to a locking element comprises a stud connected to said slide and projecting through a lateral groove in said casing.

12. The double action casement bolt as defined by claim 10 wherein each of said slides comprises a ramp, said ramps forming an opening which narrows in the direction that said control rod pivots away from said peripheral surfaces, such that said catches, upon contacting said ramps during the pivoting of said at least one control rod way from said peripheral surfaces, separate said slides.

13. The double action casement bolt as defined by claim 4 further comprising:

(a) a hub mounted on said at least one control rod;

(b) a positioning pawl slideably mounted in said hub for retaining said at least one control rod in at least one stationary position along the path defined by the pivoting of said at least one control rod; and (c) resilient means for urging said positioning pawl out of said hub to retain said control rod in said at least one stationary position.

14. The double action casement bolt as defined by claim 13 wherein said at least one stationary position comprises three stationary positions.

15. The double action casement bolt as defined by claim 14 wherein two of said three stationary positions comprise:

(a) a first stationary position situated such that, when said at least one control rod is in said first stationary position, said catches compel said opposed levers to pivot apart to said first position of said opposed levers; and (b) a second stationary position such that, when said at least one control rod is in said second stationary position, said catches compel said opposed levers to pivot together to said second position of said opposed levers.

16. The double action casement bolt as defined by claim 15 wherein said three stationary positions further comprise a stationary position intermediate to said first and second stationary positions, such that, when said at least one control rod is in said intermediate position, said catches are withdrawn a sufficient distance form said opposed levers to enable said opposed levers to pivot apart to said second position of said opposed levers.

17. The double action casement bolt as defined by claim 16 wherein said positioning pawl comprises a head, and wherein, when said at least one control arm is in said intermediate position, said heads is biased into a stop hole in said casement.

* * * * *